US005987911A

United States Patent [19]

Arai et al.

[11] Patent Number: 5,987,911

[45] Date of Patent: Nov. 23, 1999

[54] AIR CONDITIONER

[75] Inventors: Yasuyuki Arai; Masaharu Miwa; Tetsuji Uchiyama; Yoshiaki Kuwahara; Kengo Takahashi, all of Tokyo, Japan

[73] Assignee: Mitsubishi Denki Kabushiki Kaisha, Tokyo, Japan

[21] Appl. No.: 09/097,696

[22] Filed: Jun. 16, 1998

[30] Foreign Application Priority Data

Nov. 13, 1997 [JP] Japan ..... 9-311938
Nov. 14, 1997 [JP] Japan ..... 9-313186

[51] Int. Cl.[6] ..... F25D 17/04; F25B 49/00

[52] U.S. Cl. ..... 62/407; 62/229; 62/404

[58] Field of Search ..... 62/214, 262, 404, 62/186, 407, 408, 187, 227, 229

[56] References Cited

U.S. PATENT DOCUMENTS

| | | | |
|---|---|---|---|
| 3,623,335 | 11/1971 | Shanner | 62/262 |
| 3,636,724 | 1/1972 | Moy | 62/215 |
| 3,640,087 | 2/1972 | Harrison et al. | 62/227 |
| 3,785,166 | 1/1974 | Schrader | 62/227 |
| 3,890,799 | 6/1975 | Sisk | 62/215 |
| 4,835,981 | 6/1989 | Rinholen | 62/229 |
| 5,295,531 | 3/1994 | Tsunekawa et al. | 165/48.1 |

FOREIGN PATENT DOCUMENTS

| | | |
|---|---|---|
| 60-55917 | 4/1985 | Japan . |
| 7-293929 | 11/1995 | Japan . |
| 8-152155 | 6/1996 | Japan . |

*Primary Examiner*—William Doerrler
*Attorney, Agent, or Firm*—Oblon, Spivak, McClelland, Maier & Neustadt, P.C.

[57] ABSTRACT

An air conditioner includes suction grill for sucking the air in a room, a front panel including an inlet port for sucking the air from the suction grill inside and a blowout port for blowing the air out into the room, a heat exchanger for working heat exchange of the air, and a blower for circulating the air, wherein a concave air passage for room temperature detection is formed on the front face of the front panel, and an air suction port for sucking air for room temperature detection is formed in suction grill at an opposite part to air passage.

5 Claims, 8 Drawing Sheets

AIR CONDITIONER

BACKGROUND OF THE INVENTION

1. Field of the Invention

The present invention relates to an air conditioner structure.

2. Discussion of the Background

FIG. 9 is a perspective view showing the outward appearance of a conventional air conditioner, wherein the air conditioner comprises an air conditioner body 1 and a front panel 2 defining the outer contour of the front half of the air conditioner. On the front panel 2 are defined a grill-shape inlet port 3 for air suction, a blow port 4 for blowing heat-exchanged air and a room temperature detection hole 5 for sucking room air to detect its temperature. Besides, a filter 6 is attached to the back of the front panel 2. FIG. 10 is a partial perspective view showing the disposition of a room temperature sensor in such air conditioner. A room temperature sensor 8 is mounted by means of a sensor holder 7 at the position corresponding to the room temperature detection hole 5, in the air conditioner, inside the front panel 2.

In the interior of such air conditioner, the air sucked through the inlet port 3 of the front panel 2 passes through the filter 6 and a heat exchanger (not shown) to exchange heat, before being blown from the blow port 4 under the front panel 2. On the other hand, the temperature of the air sucked through the room temperature detection hole 5 is detected by the room temperature sensor 8 and the air conditioner is controlled based upon receiving its detection signal.

However, in the conventional air conditioner of the composition as mentioned above, the room temperature could not detected precisely, because the room temperature sensor 8 disposed inside the front panel 2 may easily be affected by the heat generated by electric motor or other electric components in the air conditioner.

On the other hand, FIG. 11 shows the inner composition of a conventional air conditioner provided with an electric heater which is activated when the heating operation starts to heat the air which can not exchange heat sufficiently on starting the operation, while FIG. 12 is a perspective view showing the composition of this electric heater.

In this air conditioner, the air sucked through a grill-shape inlet port 3 of a front panel 2 is heat-exchanged by a heat exchanger 13 to pass through an electric heater 14, before being blown from a blow port 4 by a blower 15. The electric heater 14, composed of electric heating elements 17 held by a metal frame 16 is attached to the inside of the air conditioner by means of the metal frame 16. Lead wires 18 of the electric heater 14 are held, for example, by winding around clamps 19 welded to the bottom of the metal frame 16.

In such conventional air conditioner, it has been necessary to attach, by welding for example, clamps for holding lead wires to the metal frame 16 composing the electric heater 14. Besides, the shape of the metal frame 16 at the side in opposition to the blower 15 was not designed carefully and, consequently, the blower 15 directly affected by the heat from the electric heating element 17 should be made of heat resistant material, resulting in cost increase.

As an independent invention, but related to the present application, Japanese Utility Model Laid-Open No. 60-55917 discloses a technique for forming clamps for holding wiring of electric motor in integration with a plastic molded casing.

SUMMARY OF THE INVENTION

The present invention has been devised to solve problems mentioned above, and adopts the composition described below, in order to decrease the number of components in the air conditioner and to reduce the heat effect from electric motor or electric heater in the air conditioner.

In the first embodiment of the present invention, an air conditioner comprises a suction grill for sucking air in a room, a front panel including an inlet port for sucking the air from the suction grill inside and a blowout port for blowing the air out into the room, a heat exchanger for working heat exchange of the air, and a blower for circulating the air, wherein a concave air passage for room temperature detection is formed on the front face of said front panel, and an air suction port for sucking air for room temperature detection is formed in said suction grill at an opposite part to said air passage. This composition allows to detect the room temperature precisely.

Besides, said air passage is extended up to said inlet port. This allows to the air to flow smoothly in said air passage.

Moreover, a holder for affixing a room temperature sensor, which is a room temperature detection element, to said air passage is molded integrally. This allows one to reduce the number of components and to attach said room temperature sensor firmly.

Furthermore, at least one hole for ventilation is formed in said air passage downstream of a room temperature sensor disposed in said air passage. This allows one to ventilate heat generated from electric motor or other electric components in the air conditioner without affecting said room temperature sensor, and to protect other electric components from the heating.

Additionally, a second concave air passage for ventilation is formed on said front panel, and at least one hole for ventilation is formed in said second air passage. This allows one to further improve the ventilation effect of the air conditioner.

In the second embodiment of the present invention, an air conditioner comprises a heat exchanger for working heat exchange of air, a blower for circulating air and an electric heater including at least one electric heating element and a metal frame, for heating the air heat-exchanged insufficiently at the start of heating operation, wherein wire holding dampers are machined integrally with said metal frame. This provides the effect of omitting clamp welding work and proposing an inexpensive air conditioner.

Moreover, said metal frame is disposed between said electric heating element and said blower, and a plurality of ventilating holes are formed in said metal frame. This allows it to drive hot air toward the blower side all the way conveniently isolating the heat, resulting in the effect of providing a inexpensive air conditioner by enlarging the range of possible material for composing the blower.

Each of said dampers includes a bent portion, where notches are provided. They allow bending of the dampers easily and have the effect of reducing the time necessary for attaching lead wire.

Moreover, holes perforated to form said dampers are used as ventilating holes. They allow to radiate heat from the electric heater easily and to improve heating properties.

BRIEF DESCRIPTION OF DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DESCRIPTION OF THE PREFERRED EMBODIMENT

First Embodiment

Figure 1:
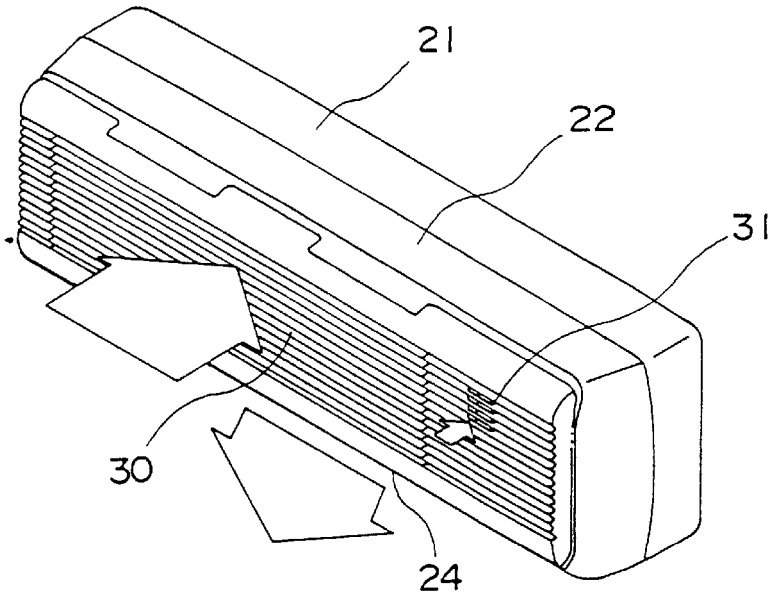
FIG. 1 is a perspective view showing the outer appearance of an air conditioner according to the first embodiment of the present invention.
Figure 2:
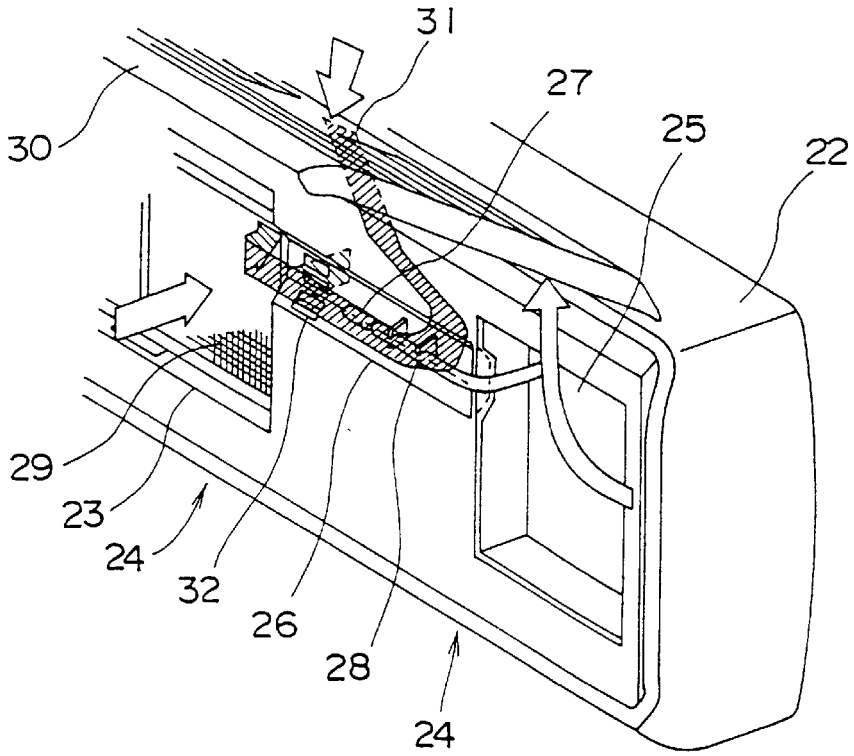
FIG. 2 is a perspective view showing an air passage for room temperature detection of a front panel according to the first embodiment of the present invention.

Now, an example of the first embodiment of the present invention will be described referring to FIG. 1 to FIG. 4. In these drawings, reference number 21 designates an air conditioner body, and 22 designates a front panel defining a front half outer contour of an air conditioner. The front panel 22 includes, on its face, a inlet port 23 for air suction and a wiring connection opening 25 for receiving the wiring and, at the bottom, a blowout port 24 for exhausting heat exchanged air. Moreover, a concave air passage 26 for room temperature detection is defined horizontally, on the face of the front panel 22. Further, a room temperature sensor 27 is held by a sensor holder 28 disposed in the air passage 26. In addition, reference number 29 designates a filter set to the inlet port 23, reference number 30 designates a suction grill attached to the front panel 22 for sucking room air, and 31 designates an air suction port for room temperature detection formed in the suction grill 30 at an opposite part to the air passage 26.

In this air conditioner, the air sucked through the suction grill 30 passes through the inlet port 23, the filter 29 and a heat exchanger (not shown), before being blown from the blowout port 24 by means of a blower (not shown).

The air passage 26 on the front panel 22 is preferably formed to lead to the inlet port 23. This will allow the air sucked from the air suction port 31 to flow towards the inlet port 23 passing through the room temperature sensor 27 disposed in the air passage 26. This allows one to detect the room temperature, and to control the air conditioner receiving the signal thereof.

Figure 3:
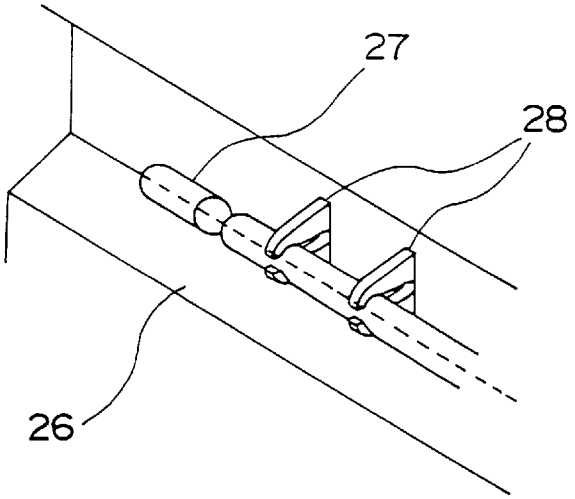
FIG. 3 is a perspective view showing a sensor holder of the front panel according to the first embodiment of the present invention.

The room temperature sensor 27 is held by a sensor holder 28 molded integrally with the air passage 26, for example, by using the elasticity of plastic material constituting, in general, the front panel 22. An example of the shape of the sensor holder 28 is shown in FIG. 3. The room temperature sensor 27 is connected to a control circuit board (not shown) in the air conditioner through the wiring connection opening 25.

Moreover, by providing at least one hole 32 for ventilation in the air passage 26 downstream of the room temperature sensor 27, the air passage 26 can also be used for ventilation in the air conditioner. In other words, the heat generated in the air conditioner can be sucked towards the blower through the hole 32, without affecting the room temperature sensor 27.

Figure 4:
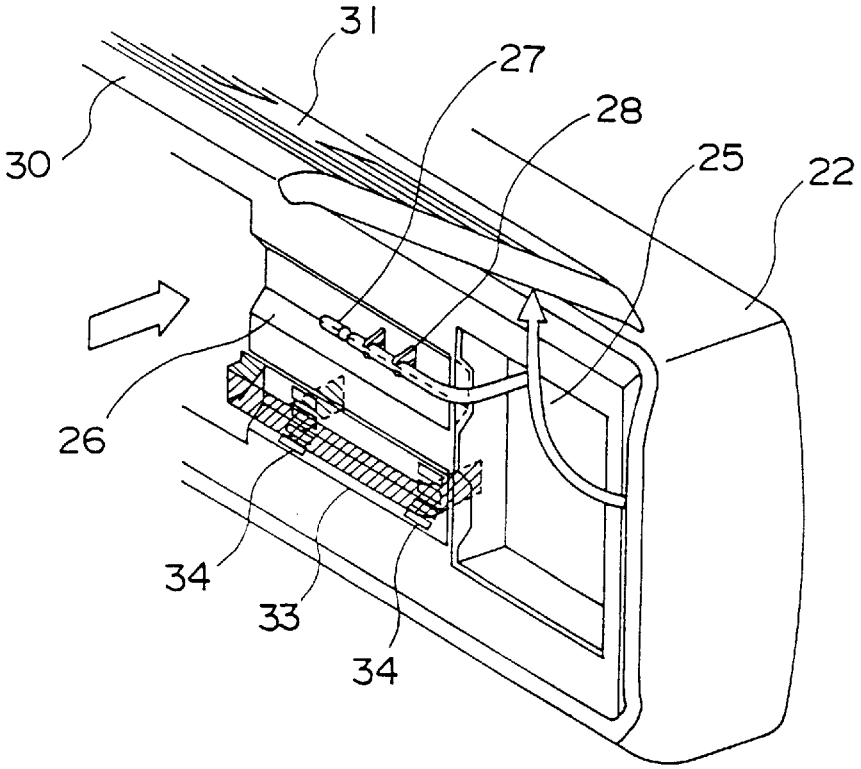
FIG. 4 is a perspective view showing an air passage for room temperature detection and a second air passage for ventilation of the front panel according to the first embodiment of the present invention.
Figure 5:
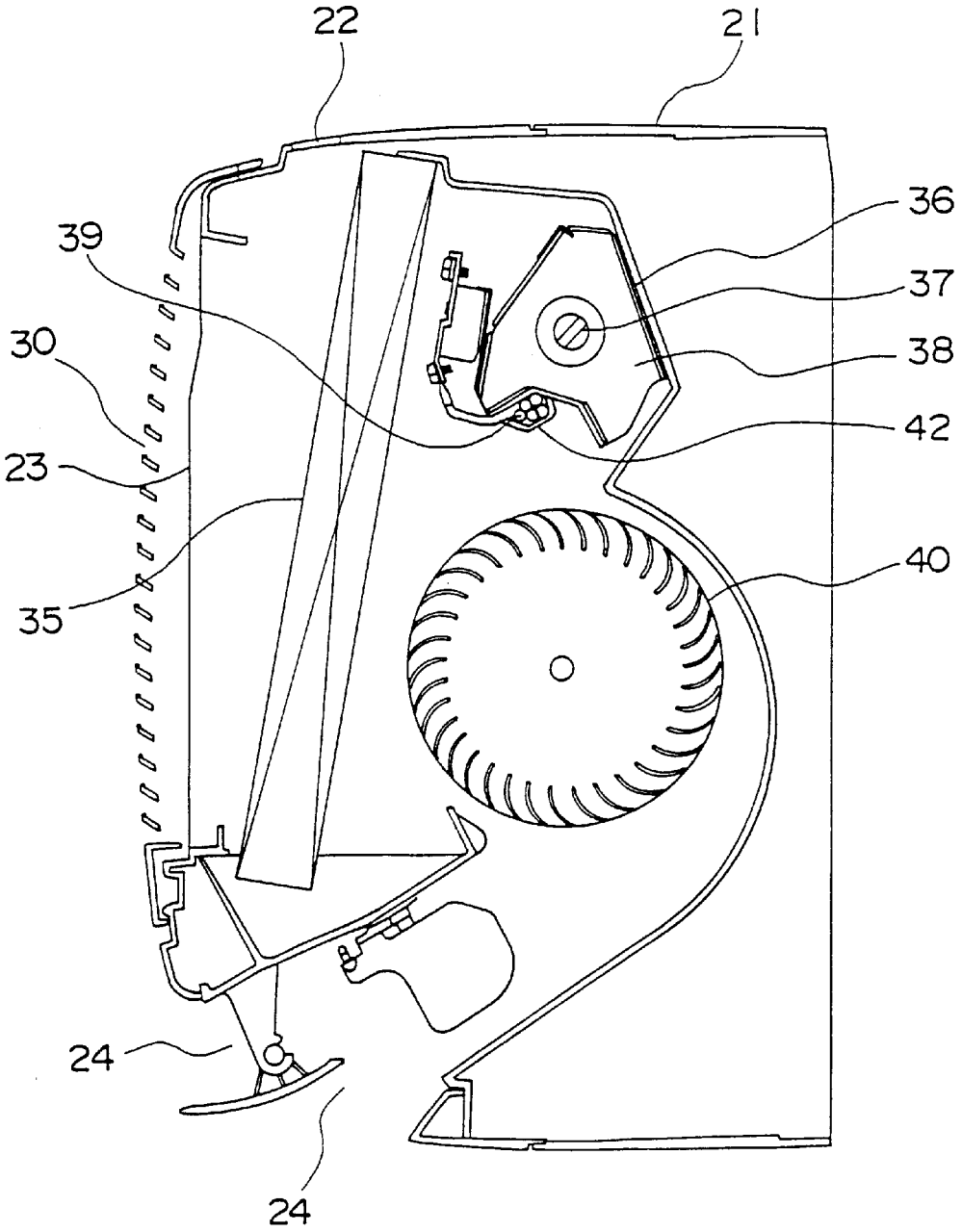
FIG. 5 is a view showing the inner composition of an air conditioner provided with an electric heater according to the second embodiment of the present invention.

Besides, as shown in FIG. 4, a second concave air passage 33 for ventilation may also be formed on the front panel 22, separately from the air passage 26, and at least one hole 34 for ventilation in the air conditioner may be formed in the second air passage 33, in order to suck the heat generated in the air conditioner towards the blower.

Second Embodiment

Next, an example of the second embodiment of the present invention will be described referring to FIG. 5 to FIG. 8. In these drawings, reference number 21 designates an air conditioner body, and 22 designates a front panel defining an inlet port 23 and a blowout port 24, and 30 designates a suction grill reference number 35 designates a heat exchanger disposed behind the inlet port 23, 36 designates an electric heater disposed behind the heat exchanger 35, and the electric heater 36 comprises an electric heating element 37 and a metal frame 38 having right side, left side, upper and lower sheet metal frames. 39 designates lead wires of the electric heater 36 and 40 designates a blower. Here, the lead wires 39 are held by dampers 42 machined integrally with the metal frame 38 by means of a press and the like.

In this air conditioner, the air sucked through the suction grill 30 and the inlet port 23, is heat-exchanged by the heat exchanger 35, passes through the electric heater 36, before being blown from the blowout port 24 by the blower 40. Activated at the start of heating operation of the air conditioner, the electric heater 36 intends to heat the air heat-exchanged insufficiently at the beginning of the operation, in order to prevent a cool air feeling.

Figure 6:
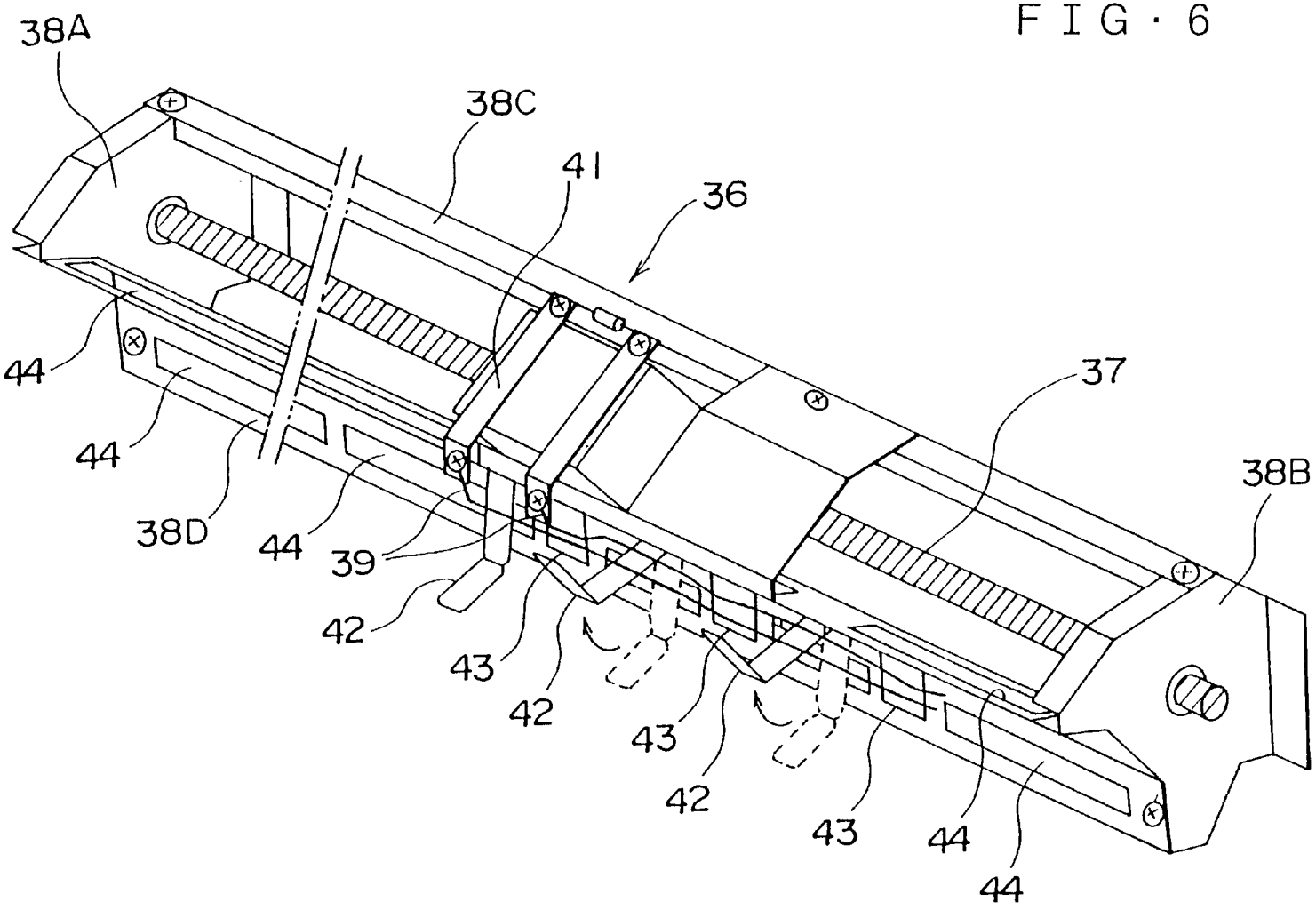
FIG. 6 is a perspective view showing the composition of the electric heater according to the second embodiment of the present invention.

Now the composition of the electric heater 36 will be described based on FIG. 6. The electric heater 36 comprises the electric heating element 37, right and left side sheet metal frames 38A, 38B holding the electric heating element 37, upper and lower sheet metal frames 38C, 38D affixed integrally with the right and left side sheet metal frames 38A, 38B and disposed over and below the electric heating element 37, and an electric connection terminal 41. Thus, the electric heater 36 is mounted inside the air conditioner by means of the metal frame 38. A plurality of lead wires 39 extending form the terminal 41 are held by a plurality of dampers 42 machined integrally with the lower sheet metal frame 38D (or upper sheet metal frame 38C).

Figure 7:
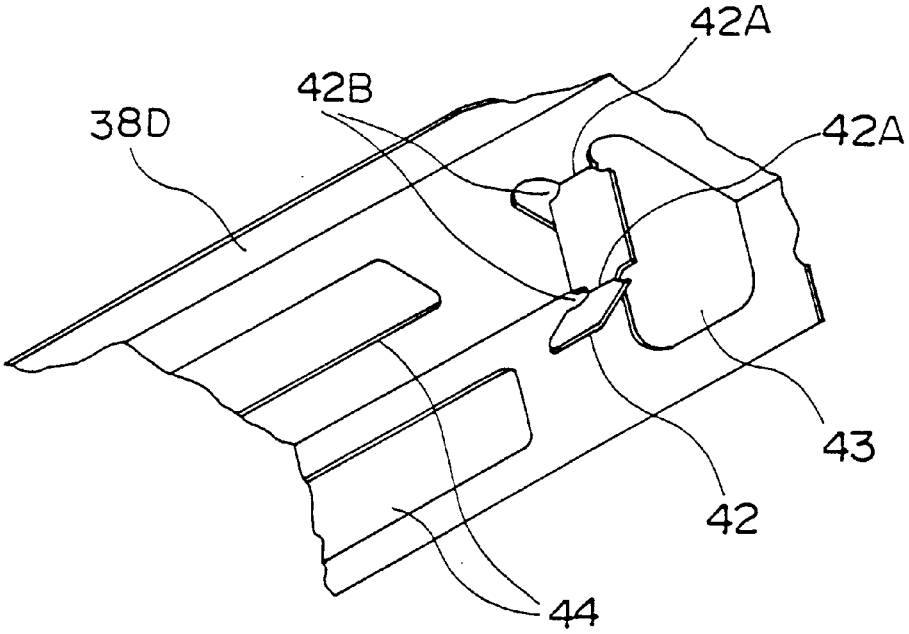
FIG. 7 is a partial enlarged view of a bottom sheet metal frame composing the electric heater according to the second embodiment of the present invention.
Figure 8:
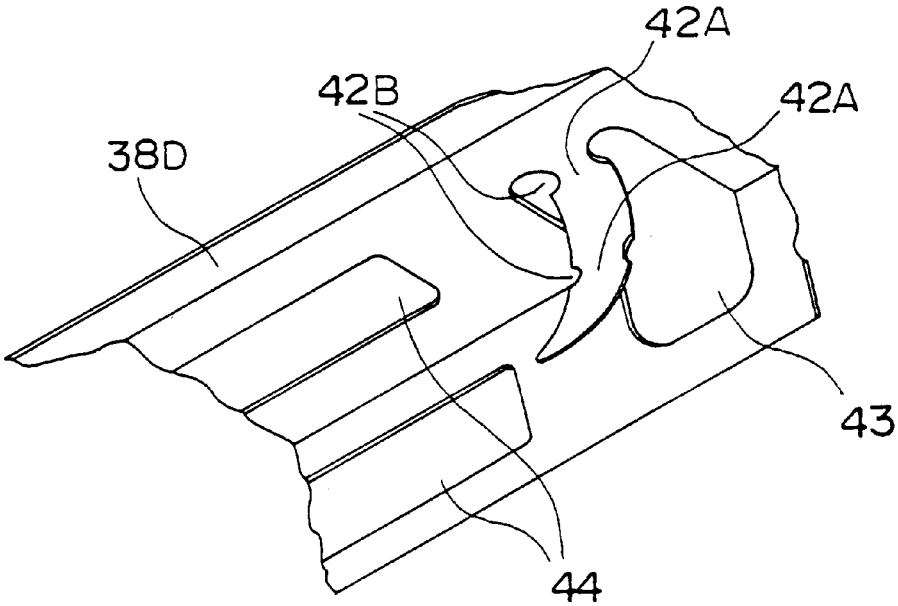
FIG. 8 is another partial enlarged view of the bottom sheet metal frame composing the electric heater according to the second embodiment of the present invention.
Figure 9:
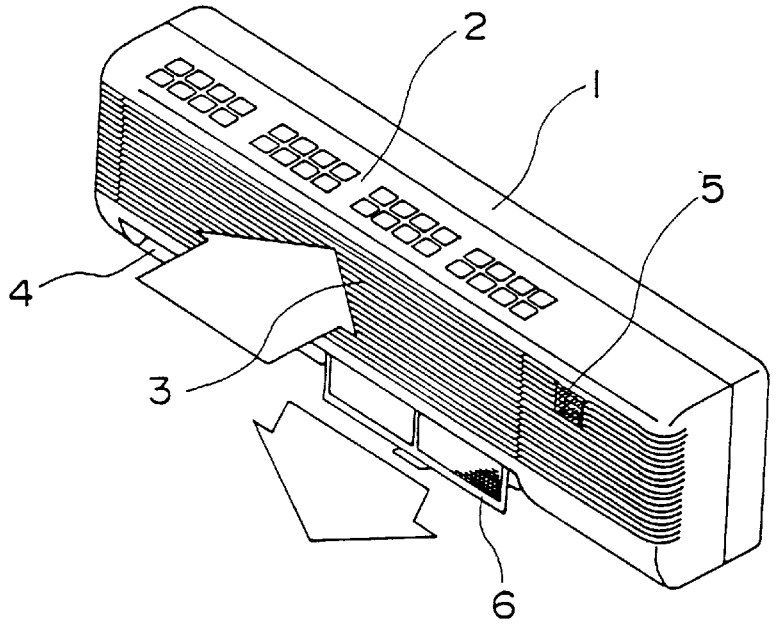
FIG. 9 is a perspective view showing the outer appearance of a conventional air conditioner.
Figure 10:
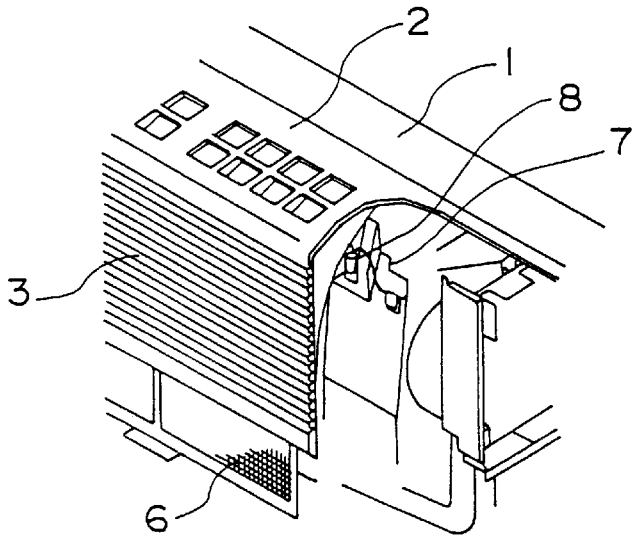
FIG. 10 is a partial enlarged view showing the disposition of a room temperature sensor inside the conventional air conditioner.
Figure 11:
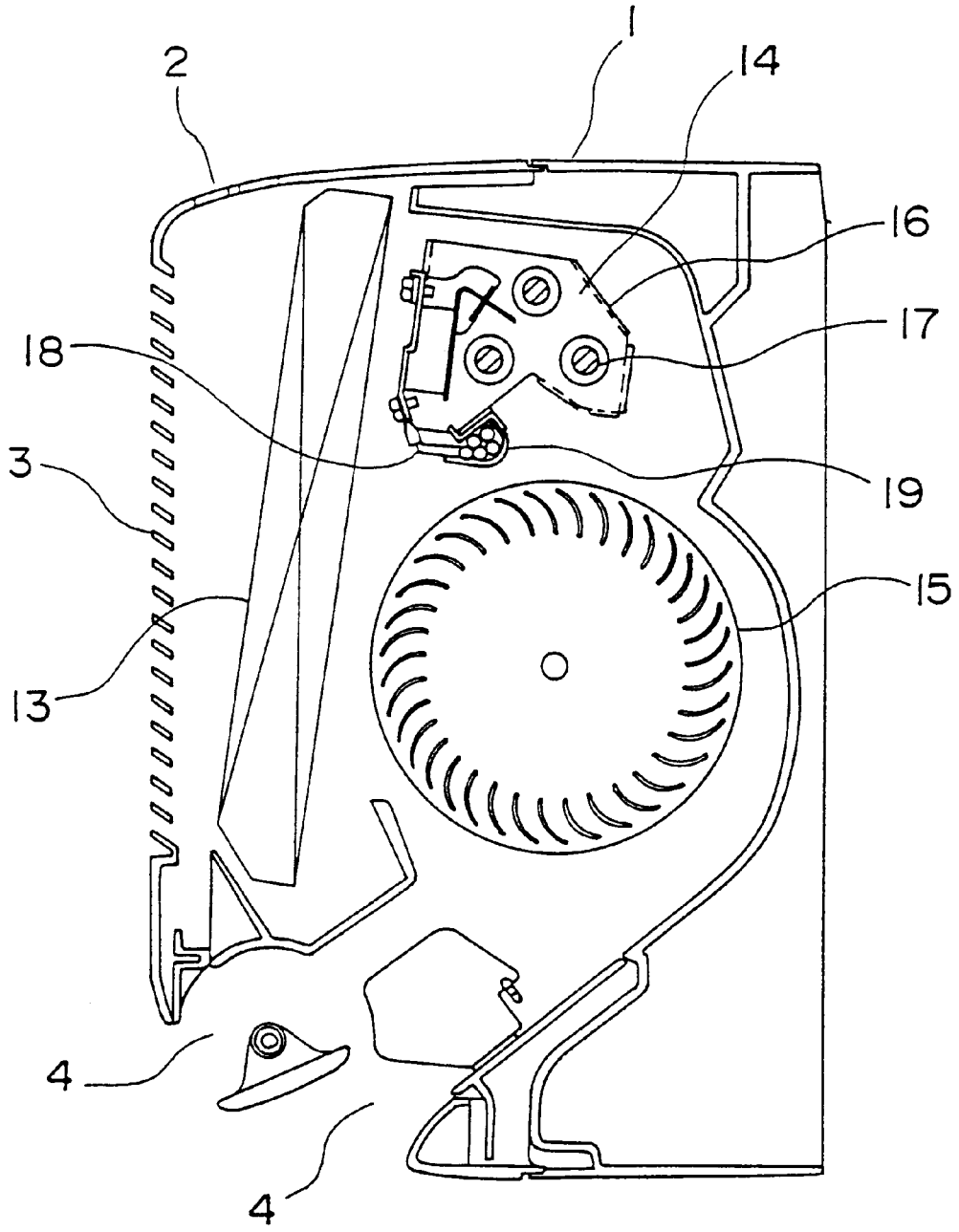
FIG. 11 is an inner composition view of a conventional air conditioner provided with an electric heater.
Figure 12:
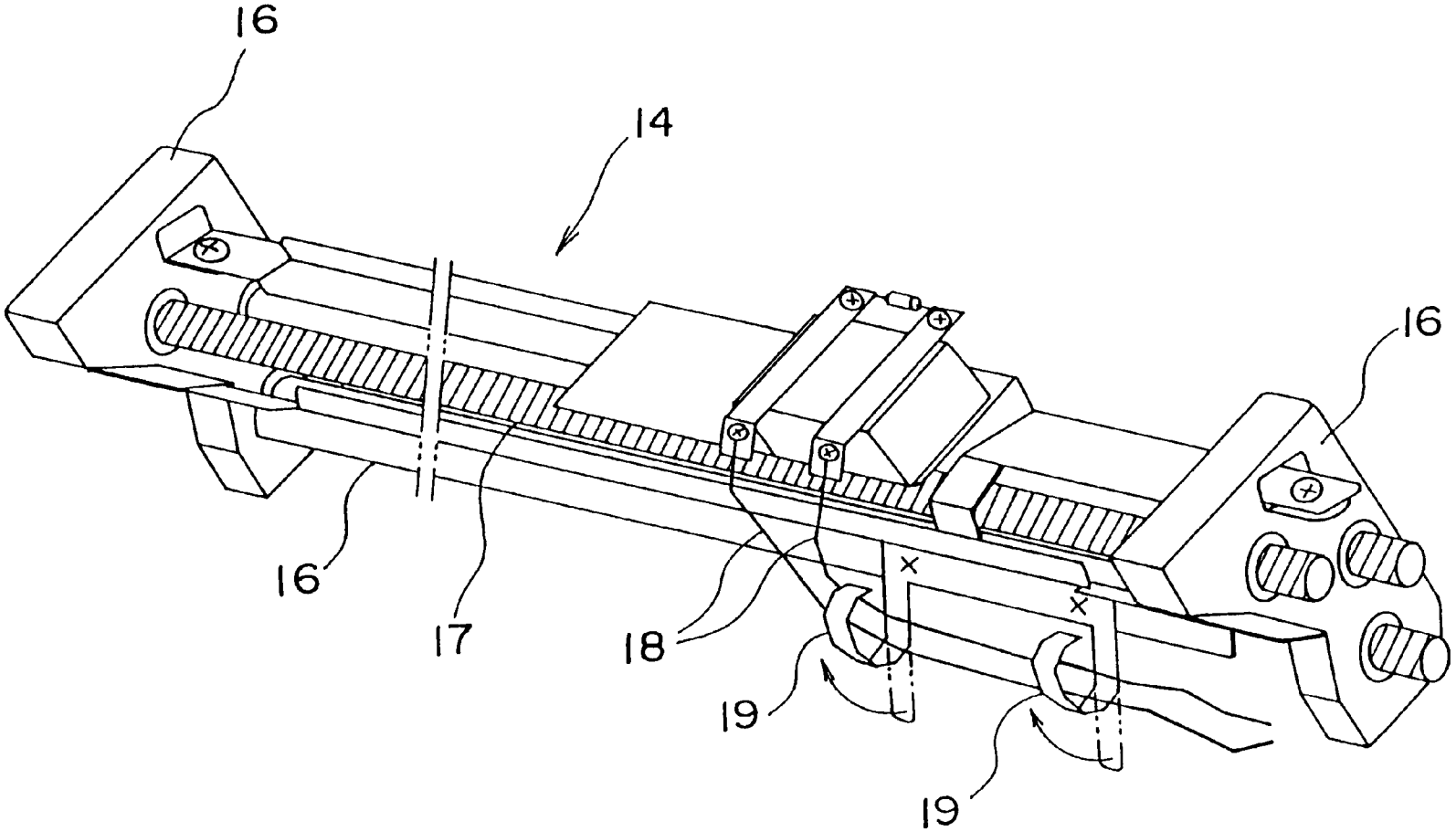
FIG. 12 is a perspective view showing the composition of the electric heater of the conventional air conditioner.

As shown in FIG. 7 and FIG. 8, each damper 42 has bent portion 42A and the bent portion 42A includes notches 42B to facilitate bending of damper 42 for holding the lead wires 39. The dampers 42 provide an advantage to facilitate wiring clamp operation, independently of the thickness of the sheet metal frame 38, by adjusting the size of the notch 42B.

Moreover, machining holes 43 are perforated to form these dampers 42 may be used as ventilating holes.

Separately from the machining holes 43, it is preferable to form conveniently a plurality of ventilating holes 44 on the lower sheet metal frame 38D placed between the electric heating element 37 and the blower 40. This will allow one to send hot air towards the blower 40 through the damper machining holes 43 and the ventilating holes 44 while at, all times appropriately heat insulating the blower from the heat of the electric heating element 37 by means of the lower sheet metal frame 38D.

Here, the damper 42 may take any form according to the lead wire 39. The shape of the bent portion 42A of the damper 42 may be angular as shown in FIG. 7, or circular as in FIG. 8. The notch 42B of the bent portion 42A also can take any appropriate shape.

We claim:

1. An air conditioner, comprising:

a suction grill for sucking air in a room, a front panel having said suction grill mounted thereto and including an inlet port for sucking the air from the suction grill inside and a blowout port for blowing the air out into the room, a heat exchanger for heat exchange of the air, a blower for circulating the air, a room temperature sensor housed separately from said heat exchanger;

a concave air passage for room temperature detection, said passage being formed on the front face of said front panel and within which said room temperature sensor is housed, and an air suction port formed in said grill for sucking air for room temperature detection said suction port being located at an opposite part of said air passage and communicating said air for room temperature detection directly to said room temperature sensor.

2. The air conditioner according to claim 1, wherein said air passage extends up to said inlet port so as to allow air to flow thereto from said air suction port.

3. The air conditioner according to claim 1, which comprises a holder for affixing the room temperature sensor thereto wherein said holder is molded integrally with said air passage.

4. The air conditioner according to claim 1, wherein at least one hole for ventilation is formed in said air passage downstream of a room temperature sensor disposed in said air passage.

5. The air conditioner according to claim 1, wherein a second concave air passage for ventilation is formed on said front panel, and at least one hole for ventilation is formed in said second air passage.

* * * * *